US009660357B1

(12) United States Patent
Worsham

(10) Patent No.: US 9,660,357 B1
(45) Date of Patent: May 23, 2017

(54) ELECTRICAL CONNECTOR WITH INTERNAL CRIMPING MECHANISM

(71) Applicant: David Worsham, Santa Rosa Beach, FL (US)

(72) Inventor: David Worsham, Santa Rosa Beach, FL (US)

( * ) Notice: Subject to any disclaimer, the term of this patent is extended or adjusted under 35 U.S.C. 154(b) by 0 days.

(21) Appl. No.: 15/077,775

(22) Filed: Mar. 22, 2016

(51) Int. Cl.
*H01R 4/36* (2006.01)
*H01R 13/52* (2006.01)
*H01R 4/38* (2006.01)

(52) U.S. Cl.
CPC ..... *H01R 4/363* (2013.01); *H01R 4/38* (2013.01); *H01R 13/5205* (2013.01)

(58) Field of Classification Search
CPC ..... H01R 4/363; H01R 13/5205; H01R 4/38
USPC ..... 439/810, 811–815
See application file for complete search history.

(56) References Cited

U.S. PATENT DOCUMENTS 3,812,453 A * 5/1974 Kiessling ..... H01R 4/5091 439/806
4,331,377 A * 5/1982 Ebbinghaus ..... H01R 4/363 439/733.1
4,401,357 A * 8/1983 Dvorachek ..... H01R 13/508 439/432
4,693,542 A * 9/1987 Heng ..... H01R 4/363 439/626
4,810,212 A * 3/1989 Norden ..... H01R 4/38 439/709
5,314,360 A * 5/1994 Jaag ..... H01R 4/363 439/806
6,210,239 B1 * 4/2001 Harting ..... H01R 4/363 439/814
6,817,910 B2 * 11/2004 Borgstrom ..... H01R 4/36 439/136
6,854,996 B2 * 2/2005 Yaworski ..... H01R 4/36 174/71 B
7,585,193 B2 * 9/2009 Hagmann ..... H01R 4/307 439/811
7,695,327 B2 * 4/2010 Bauerle ..... H01R 4/363 439/811
7,798,869 B1 * 9/2010 Konopacki ..... H01R 4/363 439/812
7,909,633 B1 * 3/2011 Miller ..... H01R 4/305 439/441

* cited by examiner

*Primary Examiner* — Tulsidas C Patel
*Assistant Examiner* — Travis Chambers
(74) *Attorney, Agent, or Firm* — Gerald M. Walsh; Leo Law Firm, LLC

(57) ABSTRACT

An electrical connector with an internal crimping mechanism. The electrical connector has a connector shell with one or more electrical connecting pins contained therein. One or more crimping screws are threaded through a hole in a wall of the connector shell. One or more crimping springs, with a first side and a second opposite side, are within the connector shell adjacent to the hole in the wall of the connector shell. There is a hole in the first side of the crimping spring through which the crimping screw passes to engage the second opposite side of the crimping spring. The crimping screw and the crimping spring are constructed to reversibly crimp an electrical wire between the second opposite side of the crimping spring and an internal wall of the connecting pin when said crimping screw is screwed into said electrical connector.

11 Claims, 5 Drawing Sheets

ELECTRICAL CONNECTOR WITH INTERNAL CRIMPING MECHANISM

FIELD OF THE INVENTION

This invention relates to enclosed electrical connectors, such as a Deutsch connectors, and, more particularly, to enclosed electrical connectors having a reversible crimping mechanism contained therein.

BACKGROUND OF THE INVENTION

Deutsch connectors are a well-known industry standard for more than 70 years, and are designed to withstand the most extreme and harshest of environments, such as those found in industrial, commercial aviation, aerospace, and military applications. In these environments it is frequently necessary to electrically connect one device to another. The electrical connections may be subjected to high voltage, high amperage, rapid signal changes, or other high electrical demands. These electrical forces may decrease the life span of the electrical components. Moreover, the physical aspects of electrical connections, such as the contacts, joints, sockets, cables, and the like, may experience repetitive stress and rough physical treatment or environmental contaminants such as dirt, dust, or moisture, inhibiting the electrical communication with the device. In these environments it is desirable to couple electrical devices, start the operation, and continue the operation with minimal electrical failure. Current cabling with Deutsch style two-way connectors significantly prolongs the durability and life of electrical connections.

In order to use Deutsch-style connectors it is necessary to crimp the wires into Deutsch-style connecting pins using a crimping tool, insert the pins into the Deutsch receptacle, and then activate a lock in the receptacle with a screw driver to hold the pins in place. A screwdriver and pliers are required to remove the wires. This process is time consuming and requires precision. What is needed is a connector that is constructed to allow the wires to be readily inserted and withdrawn without the use of tools.

SUMMARY OF THE INVENTION

This invention is an electrical connector with an internal crimping mechanism. The electrical connector has a connector receptacle or shell with one or more electrical connecting pins therein. One or more crimping screws are threaded through a hole in a wall of the connector shell. One or more crimping springs, with a first side and a second opposite side, are within the connector shell and are adjacent to the hole in the wall of the connector. There is a hole in the first side of the crimping spring through which the crimping screw passes to engage the second opposite side of the crimping spring. The crimping screw and the crimping spring are constructed to crimp an electrical wire between the second opposite side of the crimping spring and an internal wall of the connecting pin. The crimping screw may be located in a housing on the connector shell. A seal may be reversibly inserted into a seal chamber in a rear end of the electrical connector. The seal may also be positioned on an insulated wire which extends a stripped portion of wire into the electrical connector. A cap may be inserted into or on the housing and may be tethered to the seal.

An advantage of the electrical connector of this invention is an internal crimping mechanism within the connector that allows a stripped wire to be inserted into the connector and then be crimped to an electrical connecting pin by turning a crimping screw.

Another advantage is a crimping spring which allows a stripped wire to be reversibly crimped to an electrical connecting pin.

Another advantage is an internal crimping mechanism within an electrical connecter which provides rapid crimping and uncrimping of a stripped wire to an electrical connecting pin therein.

DETAILED DESCRIPTION OF THE INVENTION

While the following description details the preferred embodiments of the present invention, it is to be understood that the invention is not limited in its application to the details of construction and arrangement of the parts illustrated in the accompanying figures, since the invention is capable of other embodiments and of being practiced in various ways.

Figure 1:
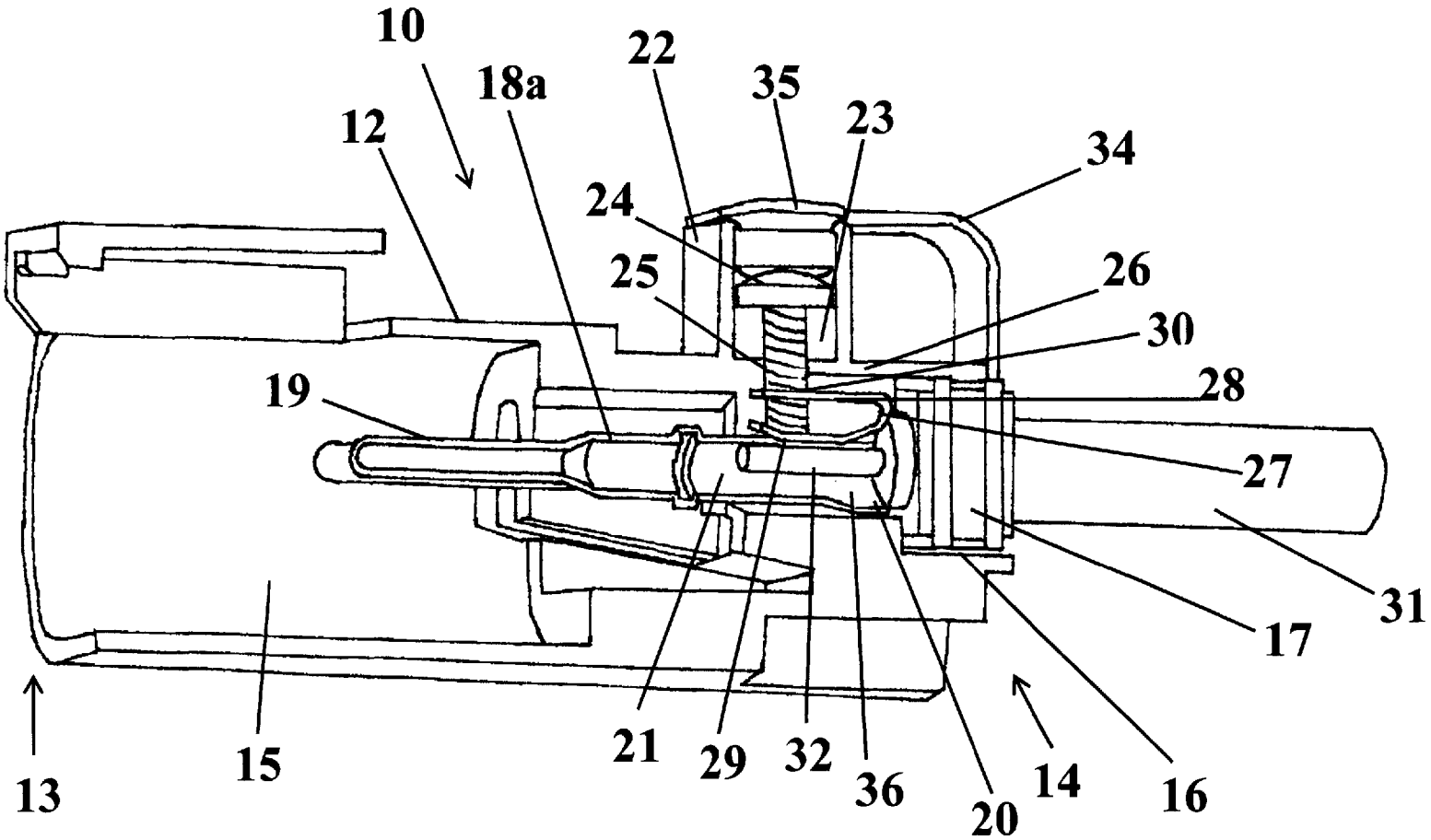
FIG. 1 shows a longitudinal sectional cutaway view of a male electrical connector and internal crimping mechanism therein.

FIG. 1 shows a longitudinal sectional cutaway view of male electrical connector 10 of this invention. The electrical connector 10 comprises a shell 12 having a front end 13 and a rear end 14. The shell 12 has a hollow interior 15 near the front end 13 and a sealing chamber 16 near the rear end 14 for insertion of a seal 17. The hollow interior 15 accommodates the insertion of a female connector 11 (see FIG. 2). Male electrical connecting pins 18*a* are shown within the shell 12. They have a front portion 19 extending into the front interior 15 and a rear portion 20 extending to the sealing chamber 16. The rear portion 20 has an open interior 21 to receive a stripped electrical conducting wire 32 from an insulated electrical wire 31. The exterior of the shell 12 has a screw housing 22 near the rear end 14 of the shell 12. The screw housing 22 has a hollow, open interior 23 to insert and house a crimping screw 24. The crimping screw 24 passes through a threaded screw hole 25 in the wall 26 of the shell 12. A U-shaped crimping spring 27, having a first side 28 and a second opposite side 29, is positioned within the interior of the shell 12. The first side 28 is near the screw hole 25. The second opposite side 29 is near the hollow interior 21 of the electrical connecting pin 18*a*. The first side 28 has a hole 30 through which the crimping screw 24 passes (see FIG. 5). The seal 17 fits into the seal chamber 16 and has a tether 34 with a cap 35 on the end of the tether 34. The cap 35 seals the interior 23 of the housing 22. The seal 17 prevents water and debris from entering the electrical connector 10 and the cap 35 prevents water and debris from entering the crimping screw housing 22.

Figure 6A:
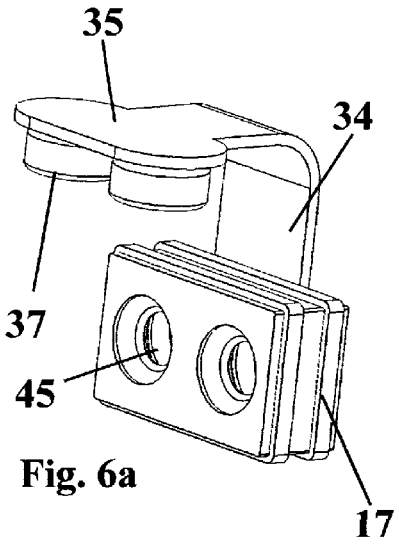
FIGS. 6*a* and 6*b* show a perspective view of the rear seal of the electrical connector and of a cap that seals the crimping screw housing of the electrical connector.
Figure 6B:
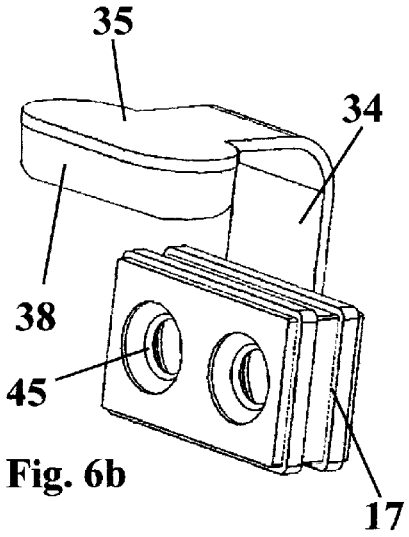

The stripped electrical conducting wire 32 passes through a hole 45 in the seal 17 (see FIGS. 6*a* and 6*b*). The seal 17 is placed in the sealing chamber 16 and an insulated electrical wire portion 31 remains in the hole 45 to complete the sealing of the rear end 14 of the electrical connector 10. The stripped wire portion 32 of the insulated electrical wire 31 is positioned in the open interior 21 of the electrical conducting pin 18*a* adjacent to the second opposite side 29 of the crimping spring 27. As the crimping screw 24 is screwed into the interior of the shell 12 through screw hole 25 it passes through the hole 30 in the first side 28 of the crimping spring 27. As the crimping screw 24 is further screwed into the interior of shell 12 it engages the second opposite side 29 of the crimping spring 27, pushes against the stripped wire 32, and crimps the stripped wire 32 against an interior wall 36 of the male electrical connecting pin 18*a*. As the stripped wire 32 is crimped between the second opposite side 29 of the crimping spring 27 and the interior wall 36 of the connecting pin 18*a*, an electrical connection is made between the stripped wire 32 and the connecting pin 18*a*.

The connector 10 is usually made with two electrical connecting pins 18, two crimping springs 27, and two crimping screws 24 to accommodate two wires 32. However, the connector 10 can be constructed to accommodate as many connecting pins, crimping screws, crimping springs, and wires as desired. The seal 17 can be constructed to accommodate as many wires as desired.

Figure 2:
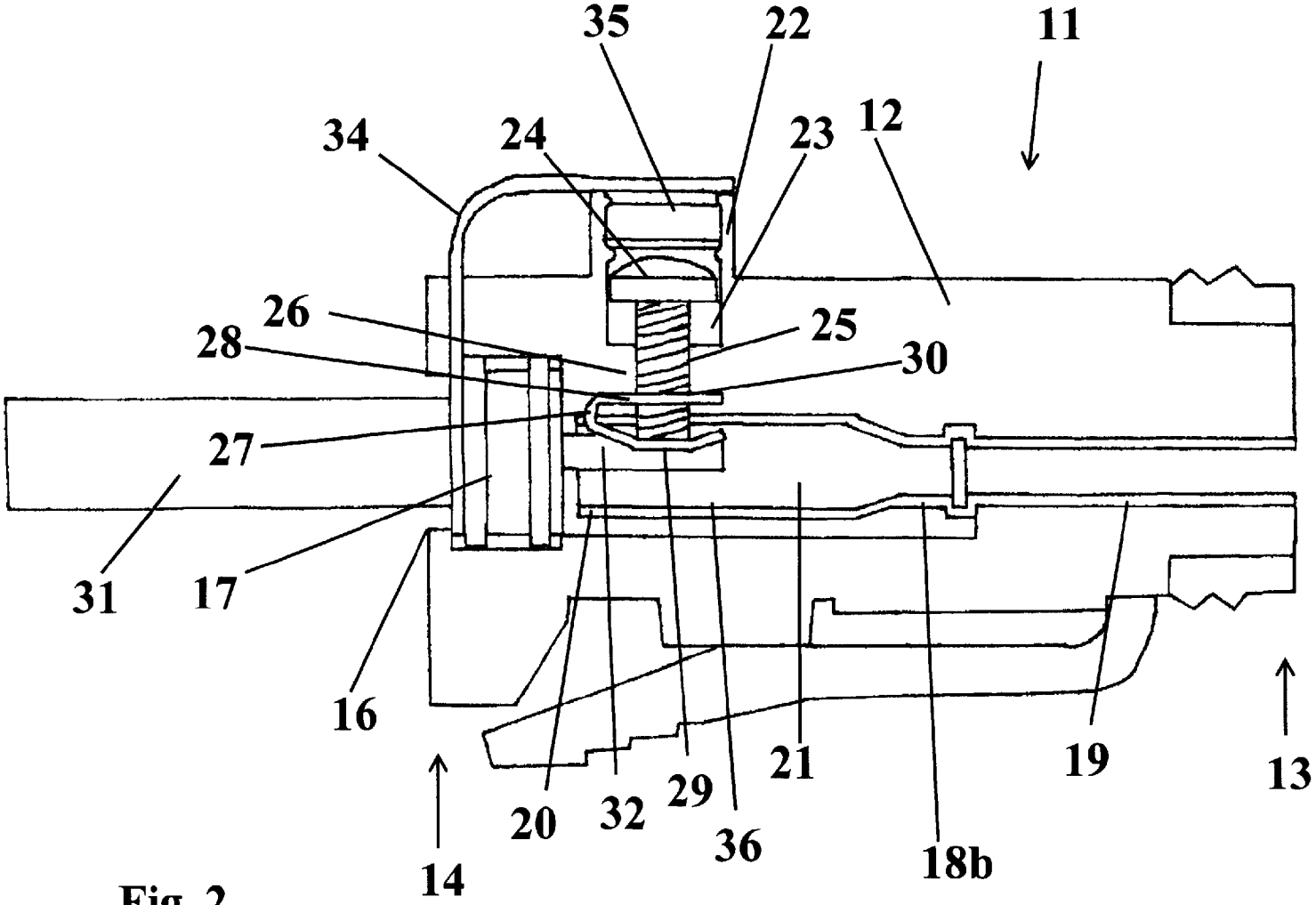
FIG. 2 shows a longitudinal sectional view of a female electrical connector and internal crimping mechanism therein.

FIG. 2 shows a longitudinal sectional view of the electrical connector 11 having female electrical connecting pins 18*b* therein. Connector 11 is the same as connector 10 except the electrical connecting pins are female and there is no hollow interior 15 near the front end 13 of shell 12. The front end 13 of connector 11 fits into the hollow interior 15 of connector 10 as is well known in the art for Deutsch connectors.

Figure 3:
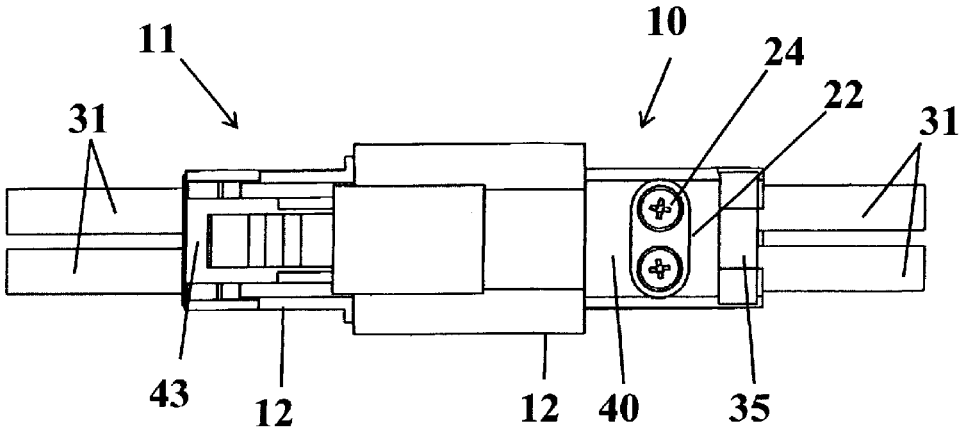
FIG. 3 shows a top view of a male connector and a bottom view of a female connector wherein the female connector is connected to the male connector.

FIG. 3 shows a view of the top 40 of a male connector 10 and a view of the bottom 43 of a female connector 11 wherein the female connector 11 is connected to (inserted into) the male connector 10. The connector 10 has two crimping screws 24 and two wires 31.

Figure 4:
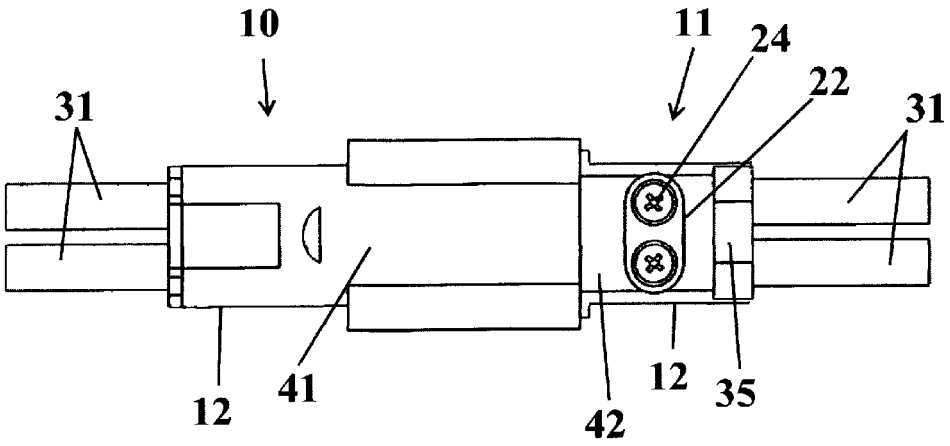
FIG. 4 shows a top view of a female connector and a bottom view of a male connector wherein the female connector is connected to the male connector.

FIG. 4 shows a view of the top 42 of a female connector 11 and a view of the bottom 41 of a male connector 10 wherein the female connector 11 is connected to (inserted into) the male connector 10. The female connector 11 has two crimping screws 24 and two wires 31.

Figure 5:
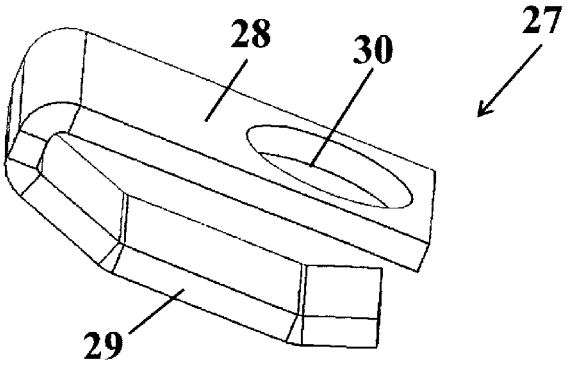
FIG. 5 shows a side perspective view of the internal crimping spring of this invention.
Figure 7A:
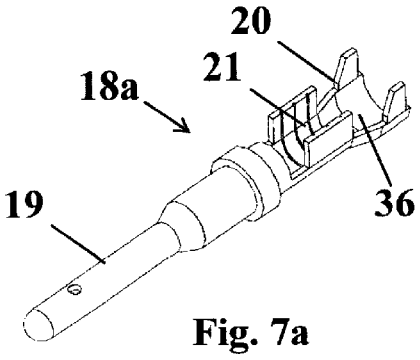
FIGS. 7*a* and 7*b* show front perspective views of male and female electrical connecting pins which are fixed within the interior of the electrical connector.
Figure 7B:
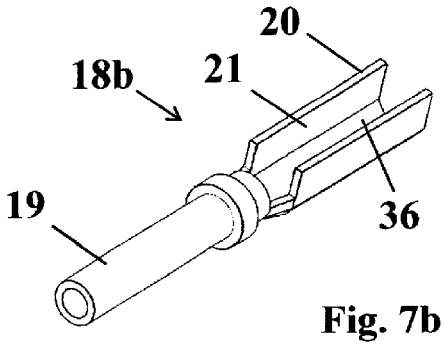

FIG. 5 shows a side perspective view of the internal crimping spring 27. FIGS. 6*a* and 6*b* show examples of the seal 17 with different types of cap 35. In FIG. 6*a* the cap 35 has plugs 37 which fit inside the crimping screw housing 22. FIG. 6*b* has a cover 28 which fits over the crimping screw housing 22. The seal is shown having two holes 45 for insertion of two insulated wires 31. FIGS. 7*a* and 7*b* show examples of a male electrical connecting pin 18*a* and a female electrical connecting pin 18*b*, respectively. The front portion 19 of female electrical connecting pin 18*b* is hollow to fit over the front portion 19 of male electrical connecting pin 18*a*, as is well known with Deutsch connectors.

Figure 8A:
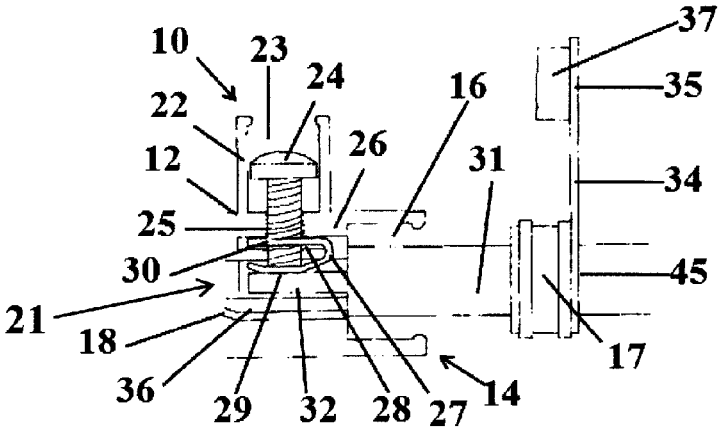
FIGS. 8*a*-8*c* illustrate the method of reversibly crimping a wire to an electrical connecting pin inside an electrical connector by means of a crimping screw and a crimping spring.
Figure 8B:
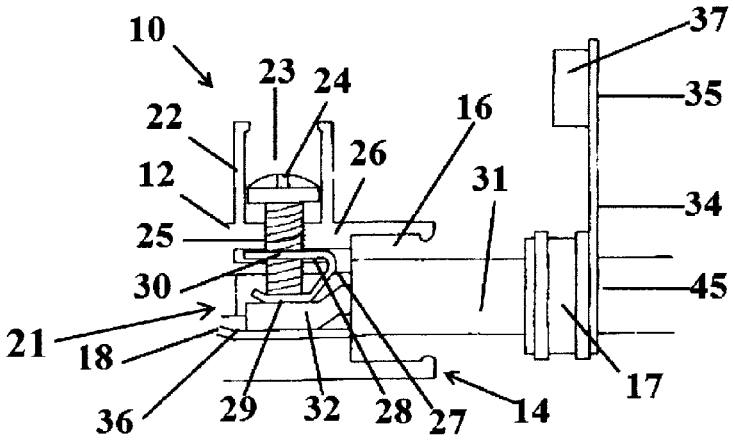
Figure 8C:
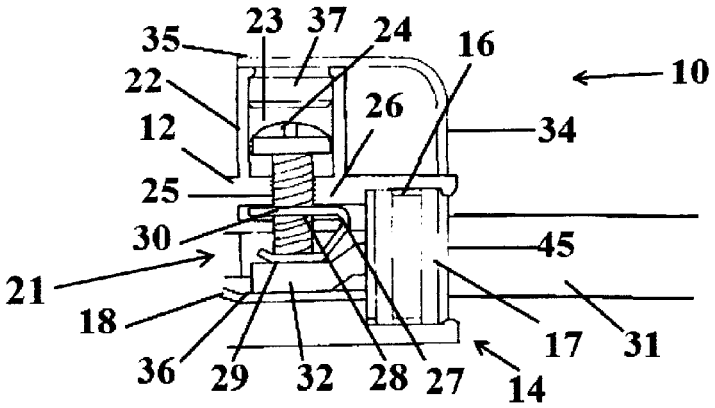

FIGS. 8*a*-8*c* are side sectional views of the crimping screw 24 and crimping spring 27, illustrating the mechanism of crimping a stripped wire portion 32 inside the connector 10 by means of the crimping screw 24 and the crimping spring 27. In FIG. 8*a* a stripped wire portion 32 is inserted into the rear end 14 of the connector 10 and into the open interior 21 of a connecting pin 18. The stripped wire portion 32 is adjacent the second opposite side 29 of crimping spring 27. The insulated wire 31 is passed through the opening 45 of seal 17 and is within the sealing chamber 16. Seal 17 is shown remaining outside the sealing chamber 16. In FIG. 8*b* the crimping screw 24 has been screwed into the interior of the shell 12 to push the bottom portion 29 of the crimping spring 27 against the stripped wire portion 32 and to push the stripped wire portion 32 against the interior wall 36 of the connecting pin 18. In this configuration the stripped wire portion 32 is crimped between the bottom portion 29 of the crimping spring 27 and the interior wall 36 of the connecting pin 18 and is, therefore, in electrical connection with the connecting pin 18. In FIG. 8*c* the seal 17 is shown advanced into the seal chamber 16, thereby sealing the connector 10. The plug 37 of cap 35 is inserted into the crimping screw housing 22, thereby sealing the crimping screw housing 22. This process can be reversed by unscrewing the crimping screw 24 to remove the stripped wire portion 32 from the electrical connector for future use, for example, to be inserted into a new electrical connector.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the electrical connectors, caps, seals, and crimping springs can be fashioned in any desired shape and size. The crimping screws and crimping springs can be made of metal or plastic. The connector can be constructed with a plurality of connecting pins, crimping screws, and crimping springs. The crimping spring can have any desired shape, can be made of plastic or metal, and may be attached or fixed within the electrical connect by any suitable means.

I claim:

1. An electrical connector with an internal crimping mechanism, comprising:

a) a connector shell with one or more electrical connecting pins therein, said electrical connecting pins having a hollow interior for insertion of an electrical wire;

b) one or more crimping screws threaded through a hole in a wall of said connector shell;

c) one or more crimping springs, with a first side and a second opposite side, within said connector shell adjacent to said hole;

d) a hole in said first side through which said crimping screw passes to engage said second opposite side; and e) said crimping screw and said crimping spring constructed to bend said electrical wire against said electrical connecting pin to create an electrical connection between said electrical wire and said electrical connecting pin, wherein said electrical connecting pin is constructed so that, when said electrical wire is inserted into said hollow interior of said electrical connecting pin, said electrical wire does not make an electrical connection with said electrical connecting pin until said crimping screw and said crimping spring bend said electrical wire against said electrical connecting pin.

2. The electrical connector of claim 1, further comprising said crimping screw being located in a housing on said connector shell.

3. The electrical connector of claim 1 further comprising a seal chamber in a rear end of said electrical connector and a seal reversibly insertable into said seal chamber.

4. The electrical connector of claim 3 further comprising said seal being positioned on an insulated wire.

5. The electrical connector of claim 2 further comprising a cap insertable into or on said housing.

6. The electrical connector of claim 5 further comprising said cap being tethered to a seal, said seal being reversibly insertable into a seal chamber in a rear end of said electrical connector.

7. An electrical connector with an internal crimping mechanism, comprising:

a) a connector shell with one or more electrical connecting pins therein, said electrical connecting pins having a hollow interior for insertion of an electrical wire;

b) one or more crimping screws threaded through a hole in a wall of said connector shell;

c) one or more crimping springs, with a first side and a second opposite side, within said connector shell adjacent to said hole;

d) a hole in said first side through which said crimping screw passes to engage said second opposite side;

e) said crimping screw and said crimping spring constructed to bend said electrical wire against said electrical connecting pin to create an electrical connection between said electrical wire and said electrical connecting pin, wherein said electrical connecting pin is constructed so that, when said electrical wire is inserted into said hollow interior of said electrical connecting pin, said electrical wire does not make an electrical connection with said electrical connecting pin until said crimping screw and said crimping spring bend said electrical wire against said electrical connecting pin;

f) said crimping screw being located in a housing on said connector shell; and g) a seal chamber in a rear end of said electrical connector and a seal reversibly insertable into said seal chamber.

8. The electrical connector of claim 7 further comprising said seal being positioned on an insulated wire.

9. The electrical connector of claim 7 further comprising a cap insertable into or on said housing.

10. The electrical connector of claim 9 further comprising a said cap being tethered to said seal.

11. An electrical connector with an internal crimping mechanism, comprising:

a) a connector shell with one or more electrical connecting pins therein, said electrical connecting pins having a hollow interior for insertion of an electrical wire;

b) one or more crimping screws threaded through a hole in a wall of said connector shell;

c) one or more crimping springs, with a first side and a second opposite side, within said connector shell adjacent to said hole;

d) a hole in said first side through which said crimping screw passes to engage said second opposite side;

e) said crimping screw and said crimping spring constructed to bend said electrical wire against said electrical connecting pin to create an electrical connection between said electrical wire and said electrical connecting pin, wherein said electrical connecting pin is constructed so that, when said electrical wire is inserted into said hollow interior of said electrical connecting pin, said electrical wire does not make an electrical connection with said electrical connecting pin until said crimping screw and said crimping spring bend said electrical wire against said electrical connecting pin;

f) said crimping screw being located in a housing on said connector shell;

g) a seal chamber in a rear end of said electrical connector and a seal reversibly insertable into said seal chamber; and h) a cap insertable into or on said housing, said cap being tethered to said seal.

* * * * *